US008454049B2

(12) United States Patent
Chen et al.

(10) Patent No.: US 8,454,049 B2
(45) Date of Patent: Jun. 4, 2013

(54) HIGH CHAIR

(75) Inventors: Chi-Chien Chen, Kaohsiung (TW); Yung-Shuen Lin, Taibao (TW)

(73) Assignee: Lerado (Zhong Shan) Industrial Co., Ltd., Zhong Shan (CN)

( * ) Notice: Subject to any disclaimer, the term of this patent is extended or adjusted under 35 U.S.C. 154(b) by 0 days.

(21) Appl. No.: 13/414,414

(22) Filed: Mar. 7, 2012

(65) Prior Publication Data

US 2013/0082455 A1 Apr. 4, 2013

(30) Foreign Application Priority Data

Sep. 29, 2011 (CN) ..... 2011 2 0368715 U

(51) Int. Cl.
*B62B 1/00* (2006.01)

(52) U.S. Cl.
USPC ..... 280/650

(58) Field of Classification Search
USPC ..... 280/650, 648, 647; 297/130, 183.2, 297/354.12, 250.1, 270.2, 27.5, 188.04
See application file for complete search history.

(56) References Cited

U.S. PATENT DOCUMENTS 5,165,755 A * 11/1992 Rho ..... 297/344.18
6,347,833 B1 * 2/2002 Chen ..... 297/328
2007/0145790 A1 * 6/2007 Ventrola ..... 297/151

* cited by examiner

*Primary Examiner* — John Walters
*Assistant Examiner* — James Triggs
(74) *Attorney, Agent, or Firm* — Muncy, Geissler, Olds & Lowe, PLLC

(57) ABSTRACT

A high chair includes a foldable support frame, a chair, and a pair of positioning mechanism. The foldable support frame has a pair of rail struts and a pair of backup struts, the pair of backup struts being pivoted to the pair of rail struts and releasably locked in a use position by a spring-biased coupling sleeve. The chair has a pair of sliding sleeves being capable of sliding alone the pair of rail struts thereby hiding the chair under a dining table. The pair of positioning mechanism are mounted on the chair and associated with a pair of locking elements mounted in the sliding sleeves for releasably locking the sliding sleeves relative to the pair of rail struts, so as to adjust and fix the chair at a selected height.

12 Claims, 14 Drawing Sheets

HIGH CHAIR

BACKGROUND OF THE INVENTION

1. Field of the Invention

The present invention relates generally to a high chair, especially to a high chair can be adjusted in height and inclination so as to hide under a dinning table for convenience.

2. Description of the Related Art

It was always a problem for parents to feed their babies either in restaurants or at home because of their height and causing parents finding difficult to enjoy their meal. Sometimes babies like to move or run in a restaurant that will cause accident easily.

High chairs are therefore invented with a food tray detachably attached to the high chair so that babies can feed themself without disturbing their parents. However, the high chair of some prior art is fixed in height and can not be adjusted, the parents would have to adjust them to feed babies when a dining table does not match the height of high chair.

One known form of high chairs is configured in an A-frame to support a seat portion of the high chair. Such high chair does permit some adjustment of height as well as adjustment to make the high chair somewhat more compact for storage. However, such a high chair can not be collapsed or folded in compact manner and therefore requires a relatively large room for storage.

Beside that, it is much inconvenient and troublesome to collapse or fold the high chair or take the high chair away from the dining table to store, and thereafter to take it back to the dining table and extend or erect for use from time to time.

SUMMARY OF THE INVENTION

To solve the mentioned problems, the present invention provides a high chair which includes at least a foldable support frame, a chair, and a pair of positioning mechanism.

The foldable support frame may have a pair of rail struts and a pair of backup struts, the pair of backup struts being pivoted to the pair of rail struts and releasably locked in a use position by a spring-biased coupling sleeve.

The chair has a pair of sliding sleeves which being capable of sliding alone the pair of rail struts for use or hiding the high chair under a dining table.

The pair of positioning mechanism are mounted on the chair and associated with a pair of locking elements mounted in the sliding sleeves for releasably locking the sliding sleeves relative to the pair of rail struts, so as to adjust and fix the chair at a selected height.

It is preferably, the chair may include a seat body capable of changing its inclination relative to the sliding sleeves between a ordinary use position and an inclined position; when the sliding sleeves being retained in the lowest position of its journey, and the seat body being adjusted and locked in the inclined position, would lower the top portion of the chair until less than twenty-eight (28) inches; by this way, to facilitate the high chair to hide under dining table without the troublesome of folding and taking it away from the dining table.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
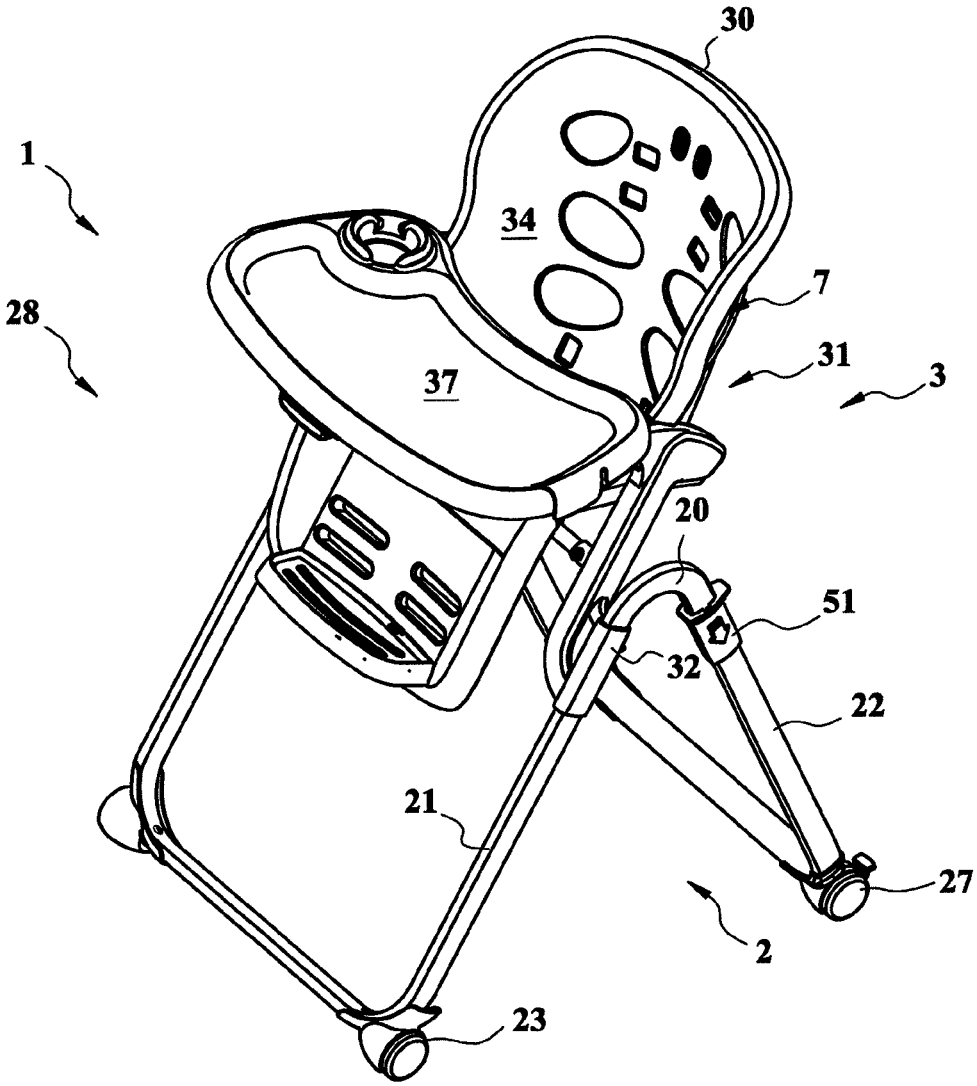
FIG. 1 is a perspective view showing an embodiment of high chair according to the present invention.
Figure 2:
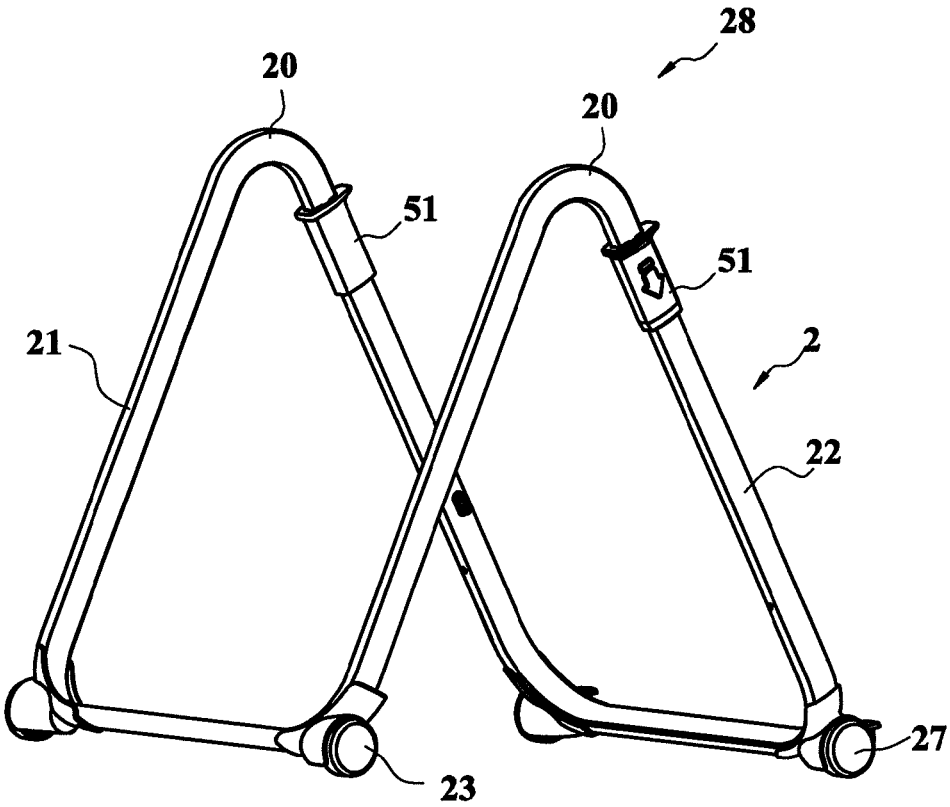
FIG. 2 is a perspective view showing a foldable support frame of the embodiment of the high chair, which having a pair of rail struts and a pair of backup struts.
Figure 3:
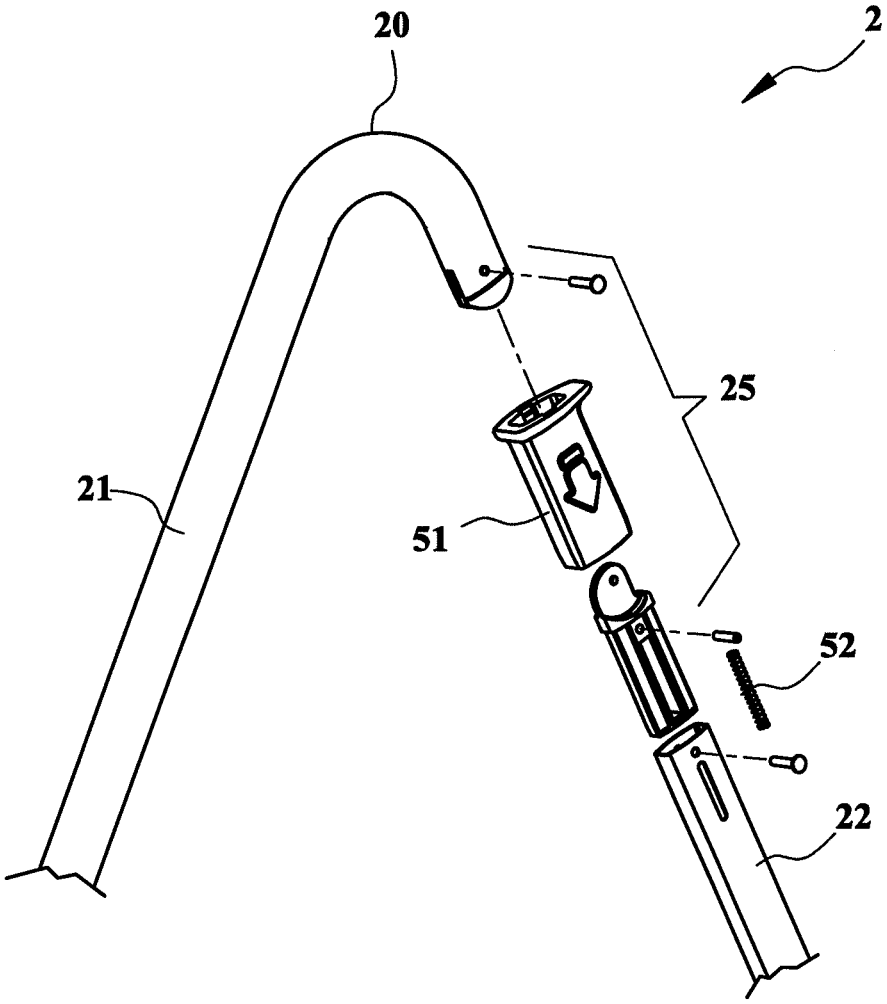
FIG. 3 is a partial exploded perspective view showing an embodiment of the foldable support frame.
Figure 4:
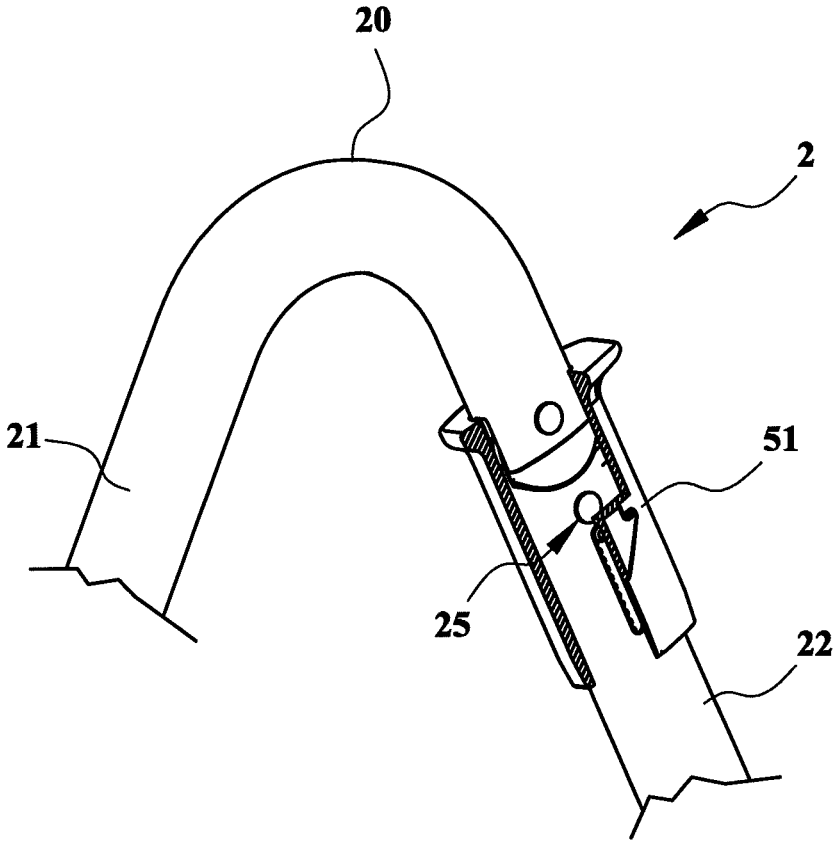
FIG. 4 is a partial schematic cross-sectional view showing the foldable support frame locked in a use position.
Figure 5:
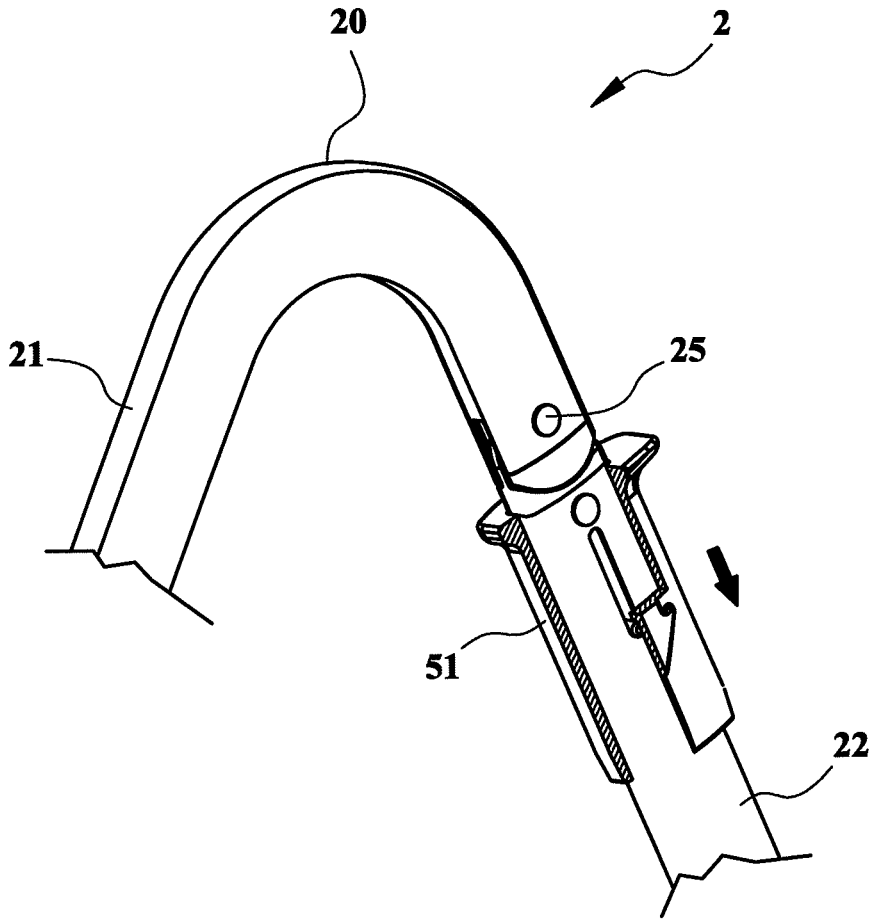
FIG. 5 is a partial schematic cross-sectional view showing the operation for unlocking the foldable support frame from the use position.

Referring to FIG. 1, a preferred embodiment of the high chair 1 according to the present invention includes a foldable support frame 2, a chair 3, and a pair of positioning mechanism 8.

Referring to FIGS. 2 to 5, the foldable support frame 2 may include a pair of rail struts 21 and a pair of backup struts 22, the pair of backup struts 22 being pivoted to the pair of rail struts 21 and releasably locked in a use position 28 by a spring-biased coupling sleeve 51. The lower end of the rail struts 21 may connect two front wheels 23 for facilitate the moving of the high chair 1 on the ground. For the same reason, two rear wheels 27 may also be connected to the backup struts 22.

Figure 6:
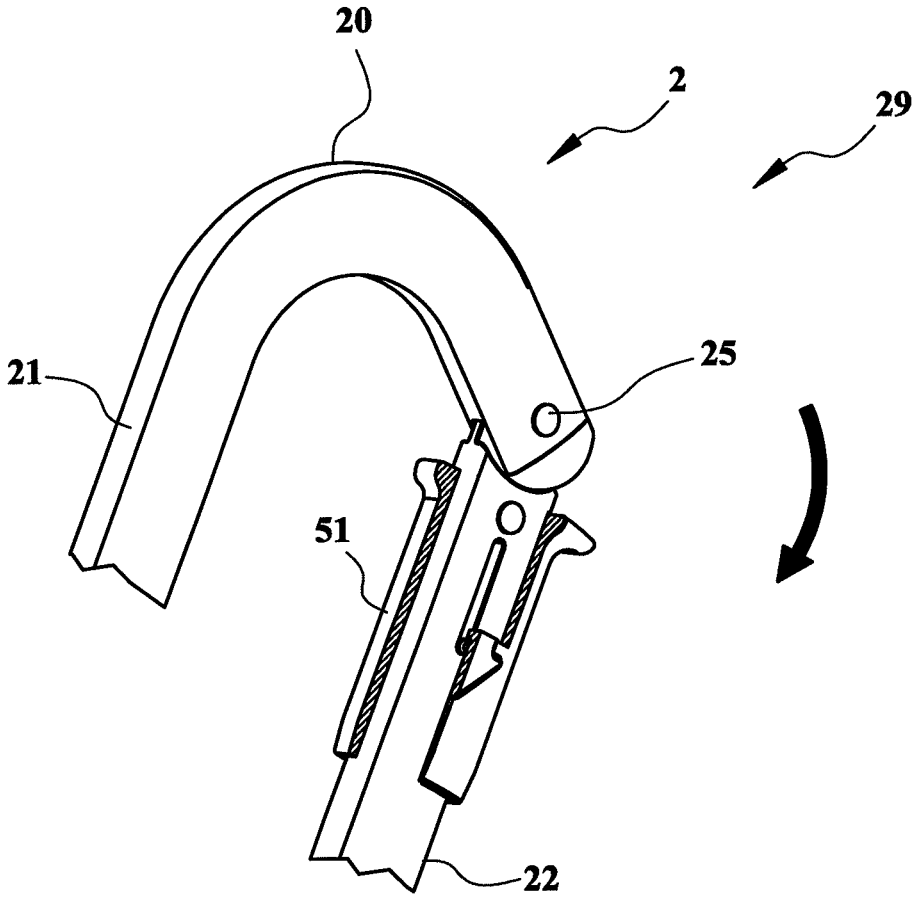
FIG. 6 is a partial schematic cross-sectional view showing the foldable support frame in a folded position.
Figure 14:
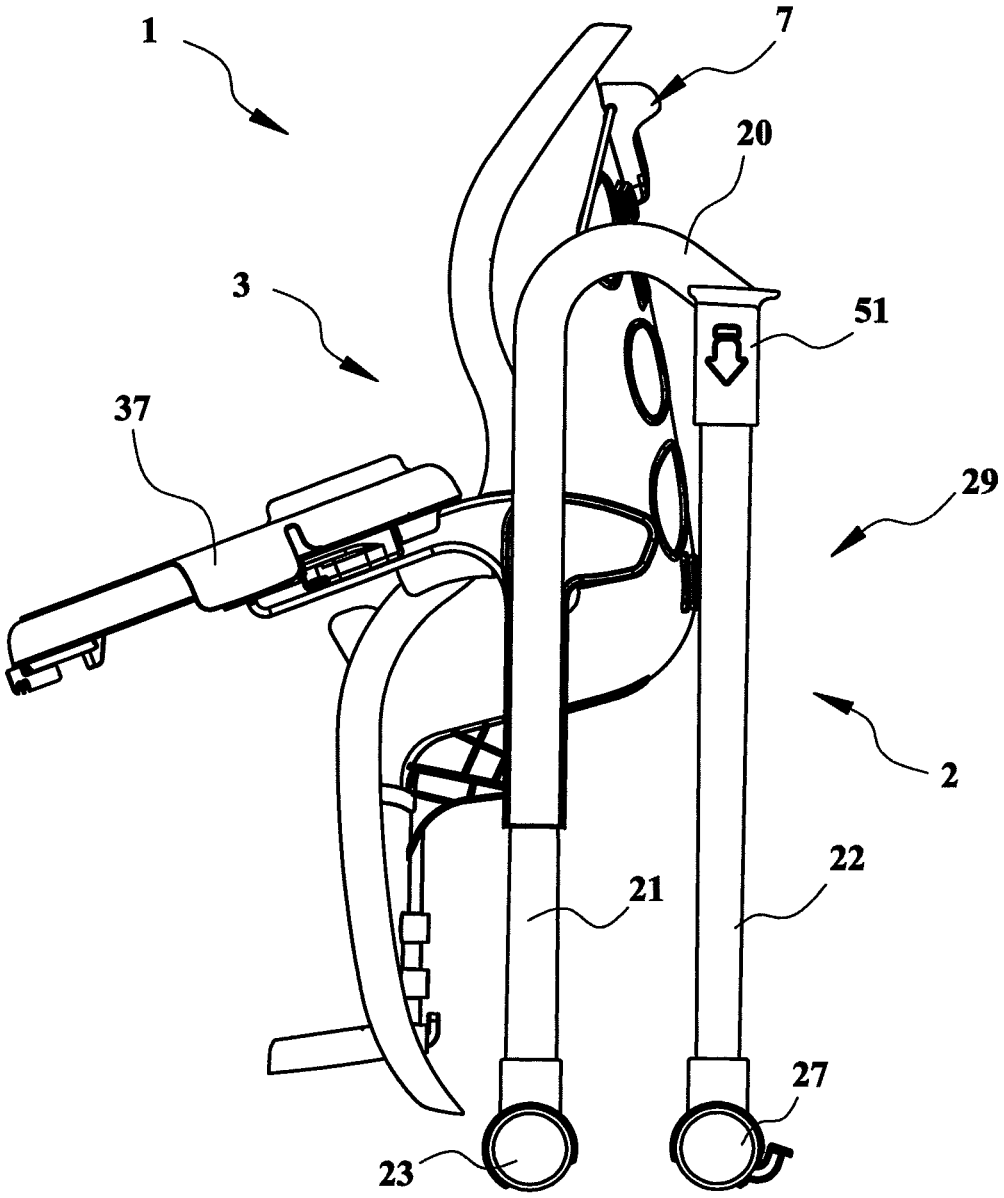
FIG. 14. is a side schematic view showing the high chair may also be folded in a storage position.

In this embodiment, the pair of rail struts 21 each has a bended section 20, and the backup struts 22 being connected to lower end of the bended section 20 by a pivot 25. The spring-biased coupling sleeve 51 is slidably coupled to upper end of the backup struts 22 and being biased by a resilient element 52 to hold the bended section 20 thereby locking the foldable support frame 2 in the use position 28; and the spring-biased coupling sleeve 51 can be withdrew from the bended section 20 so as to permit the backup struts 22 to rotate to a folded position 29 as shown in FIGS. 6 and 14.

Figure 13:
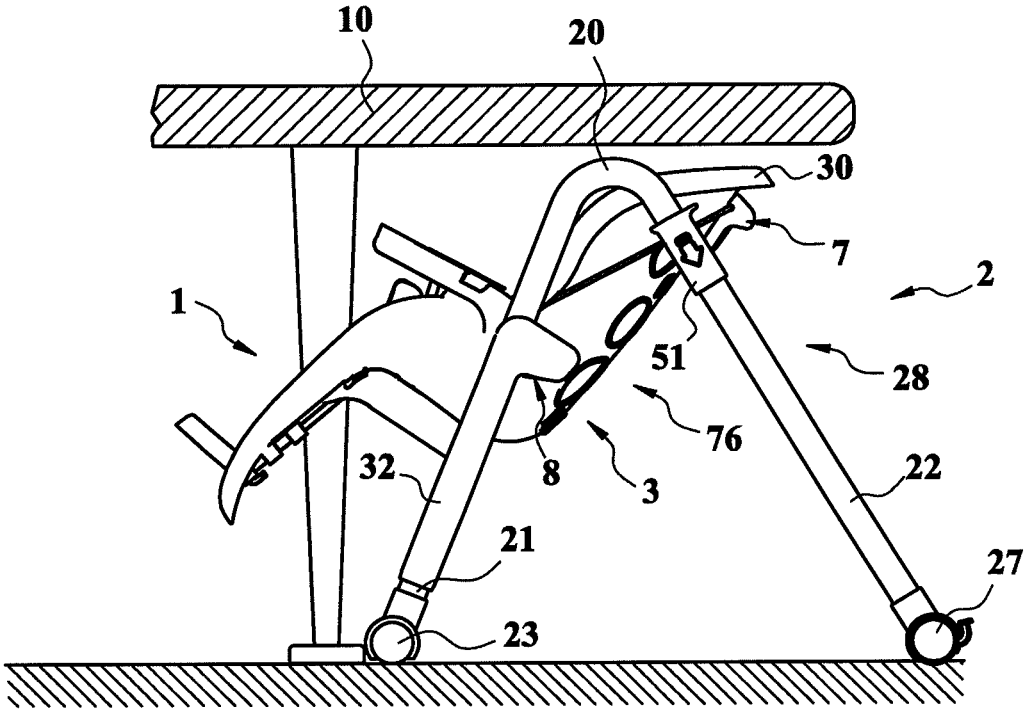
FIG. 13. is a side schematic view showing the high chair may be hid under the dining table without the troublesome of folding the foldable support frame.

Referring to FIGS. 7 to 10, the chair 3 may include a pair of sliding sleeves 32 that capable of sliding alone the pair of rail struts 21 thereby hiding the chair 3 under a dining table 10 as shown in FIG. 13. The chair 3 may further include a pair of armrests 35 extended integrally from the sliding sleeves 32. In the embodiment as shown in FIGS. 1 and 14, a food tray 37 may be used to engage with the pair of armrests 35. The food tray 37 may slidably engage to the pair of armrests 35, and the armrests 35 each being formed with a plurality of positioning indents 38 for positioning the food tray 37 in a selected position.

Figure 8:
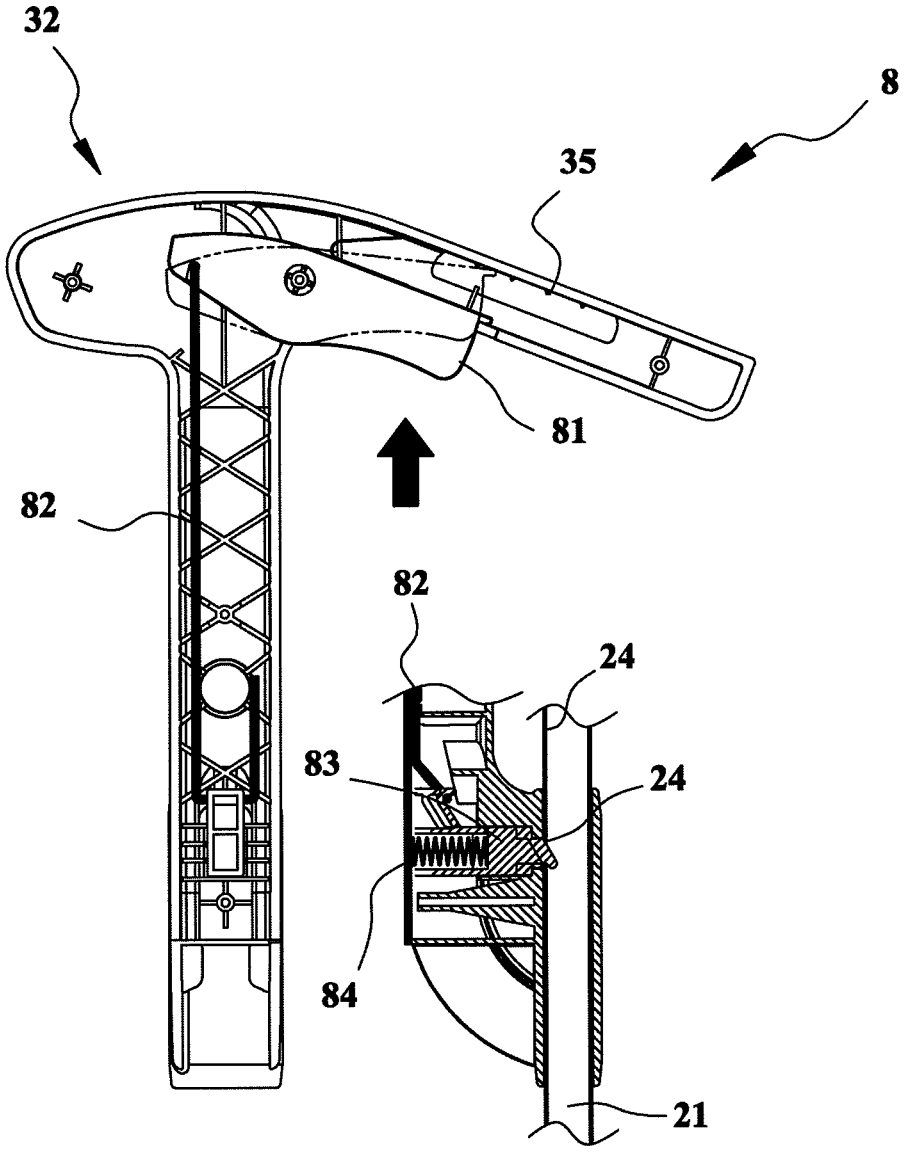
FIG. 8. is a cross-sectional view showing the operation of the sliding sleeve.
Figure 9:
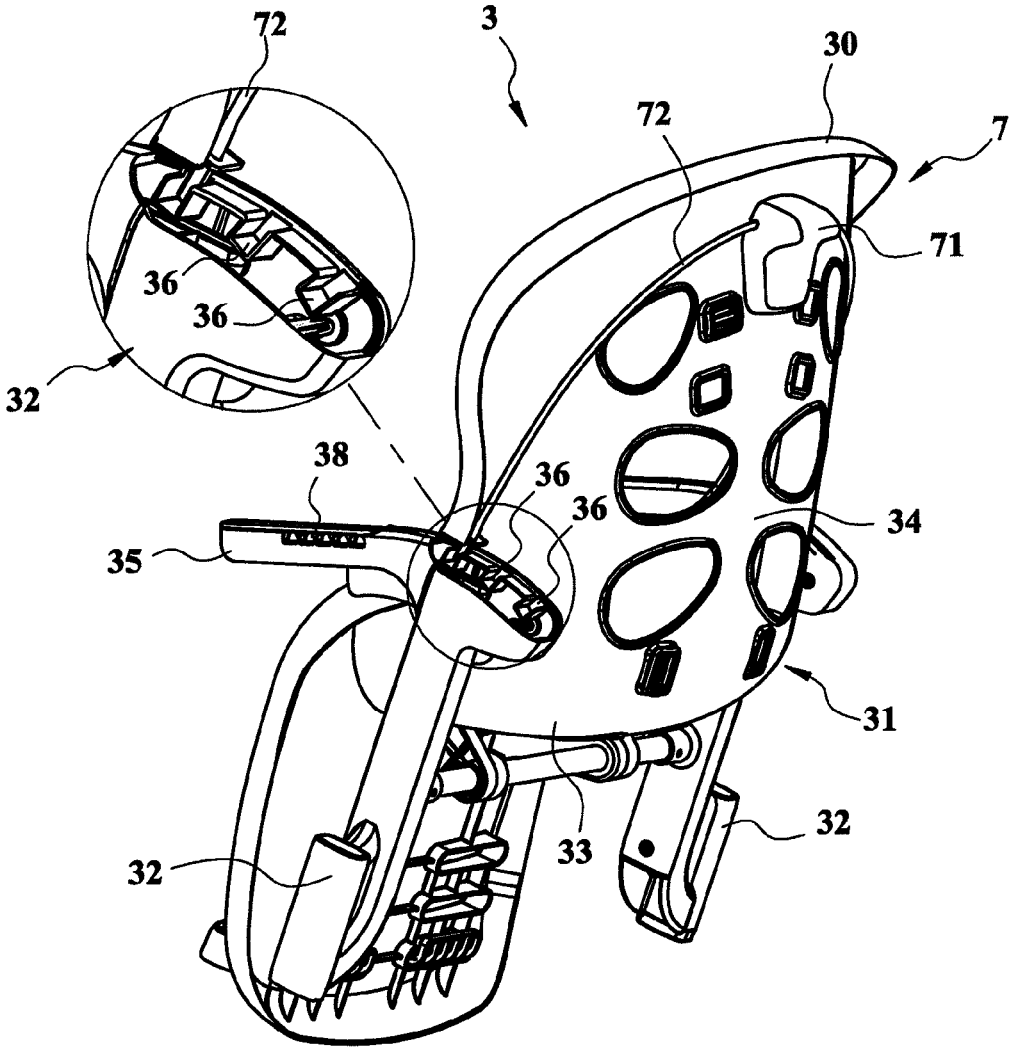
FIG. 9. is a rear-left perspective view showing the sliding sleeve connected a seat body of the high chair.
Figure 10:
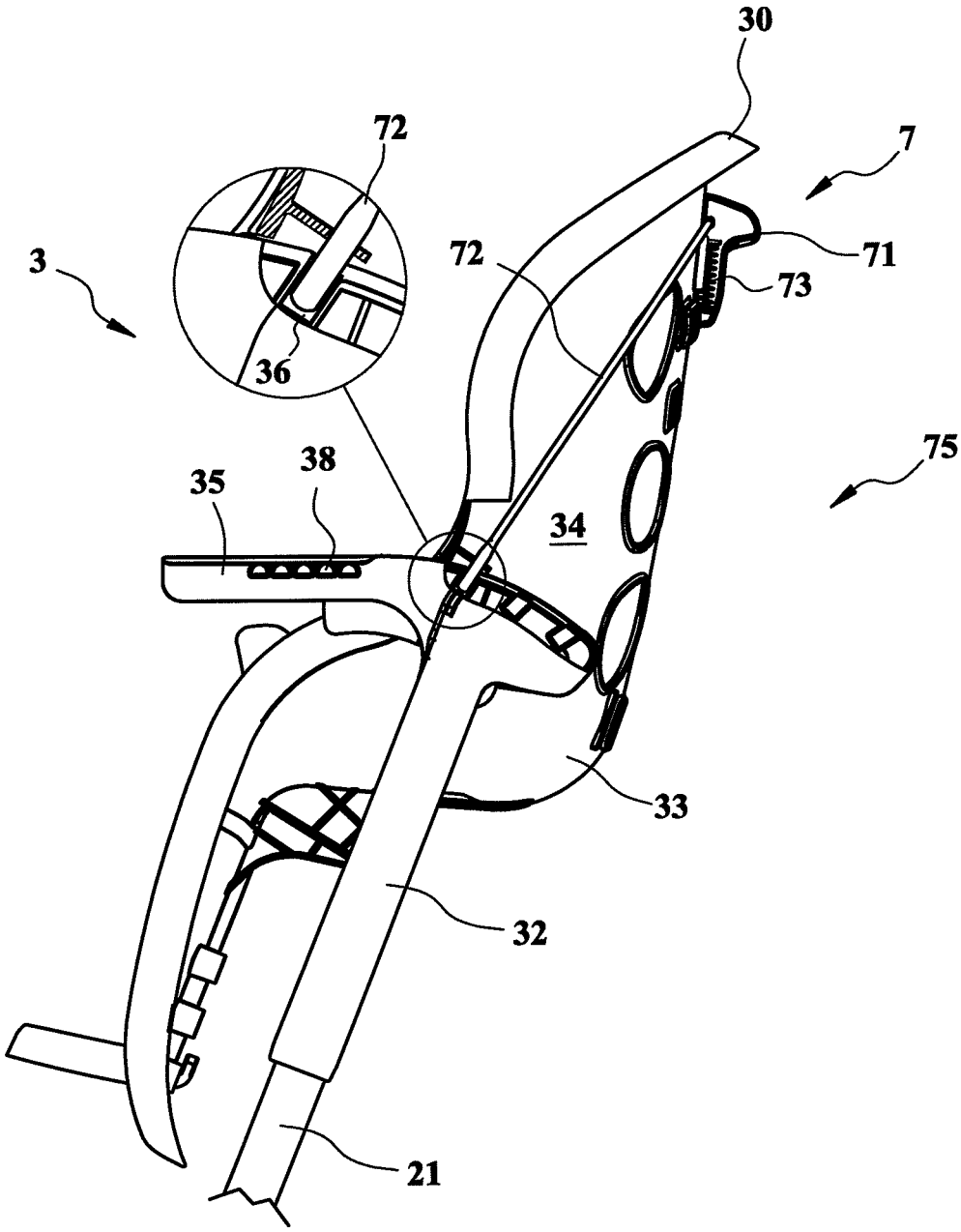
FIG. 10. is a side view showing the sliding sleeve and the seat body locked in a use position.

Referring to FIGS. 8 to 10, the pair of positioning mechanism 8 are mounted on the chair 3 and associated with a pair of locking elements 83 which being mounted in the sliding sleeves 32 for releasably locking the sliding sleeves 32 relative to the pair of rail struts 21, so as to adjust and fix the chair 3 at a selected height.

Figure 7:
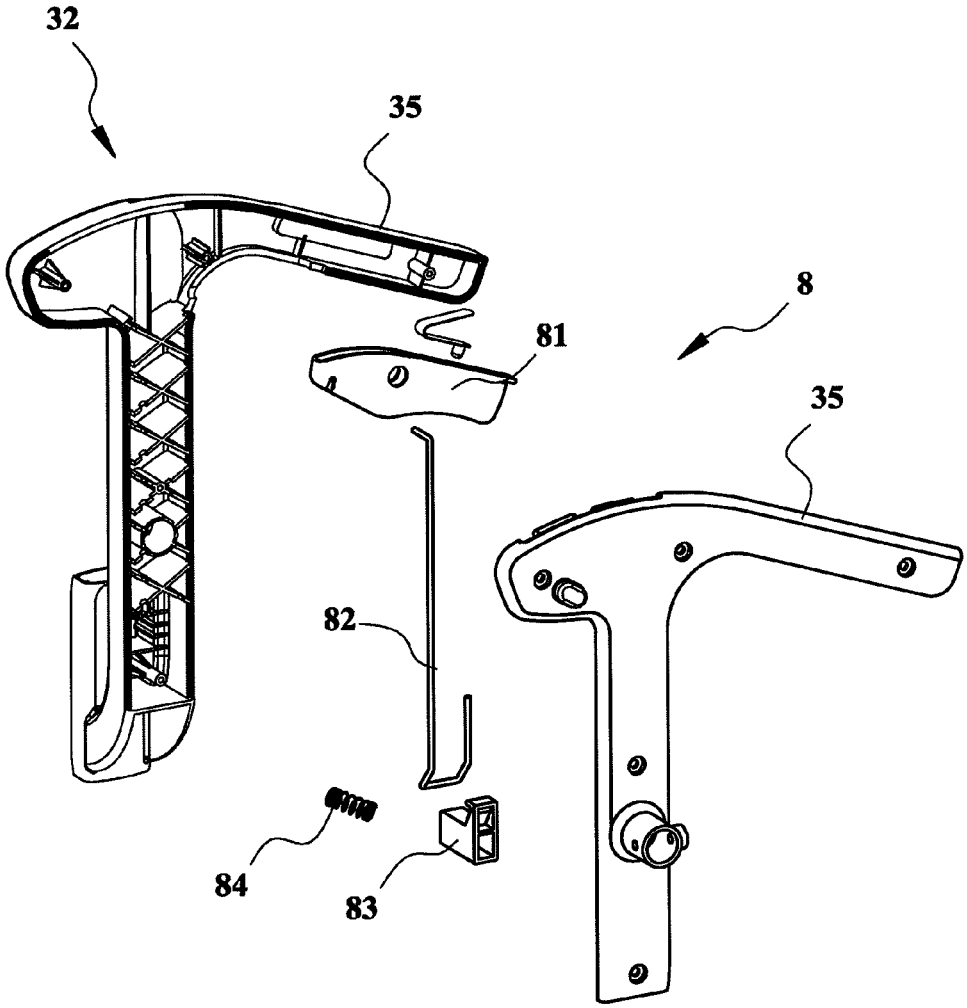
FIG. 7. is an exploded perspective view showing a sliding sleeve of the embodiment of the foldable support frame.

In one embodiment as shown in FIGS. 7 and 8, the pair of rail struts 21 are formed with a plurality of positioning holes 24 for engaging with the locking elements 83, and each of the locking elements 83 being biased by a spring 84 to engage in one of the positioning holes 24 for adjustably locking the chair 3 at a selected height.

Preferably, the positioning mechanism 8 may include a pair of driving triggers 81 associated with the locking elements 83 for disengaging the locking elements 83 from the positioning holes 24, by this way, to adjust the chair 3 to another selected position. For remote manipulating, the positioning mechanism 8 may further include a pair of linking element 82 for connecting between the driving triggers 81 and the locking elements 83.

Figure 11:
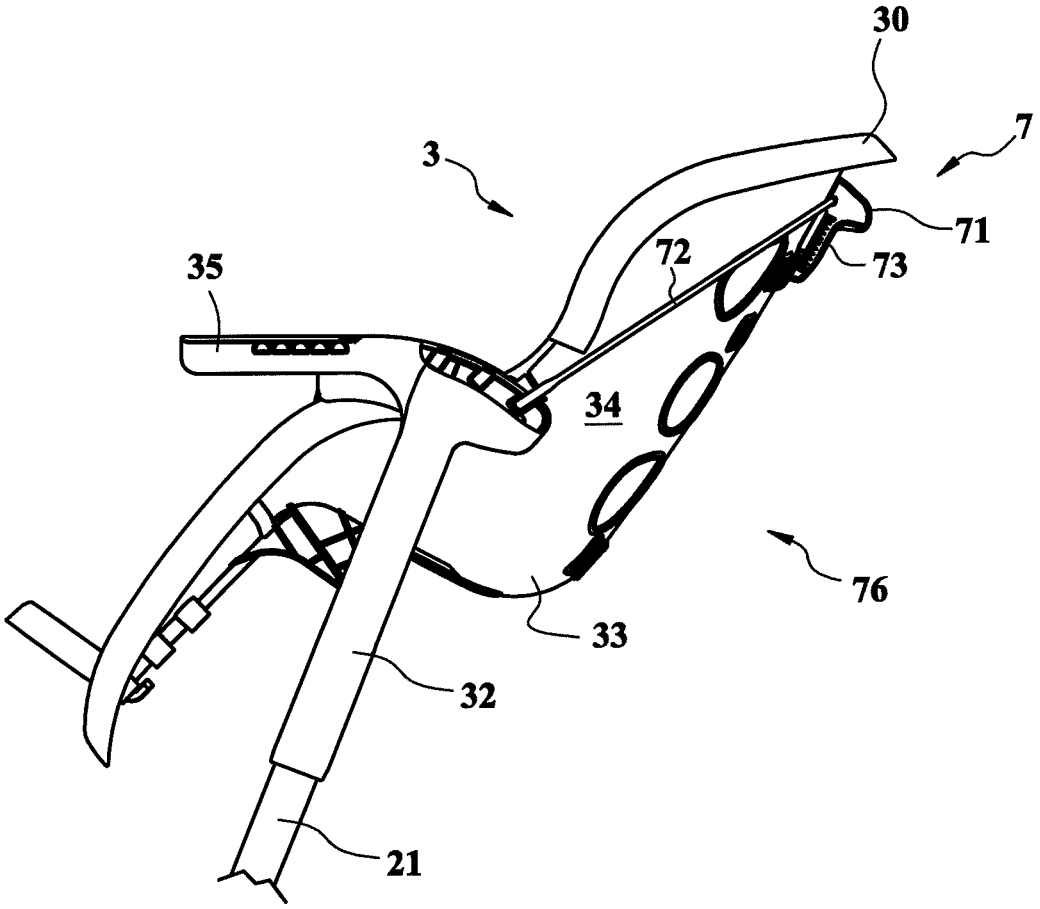
FIG. 11. is a side view showing the sliding sleeve and the seat body locked in an inclined position.
Figure 12:
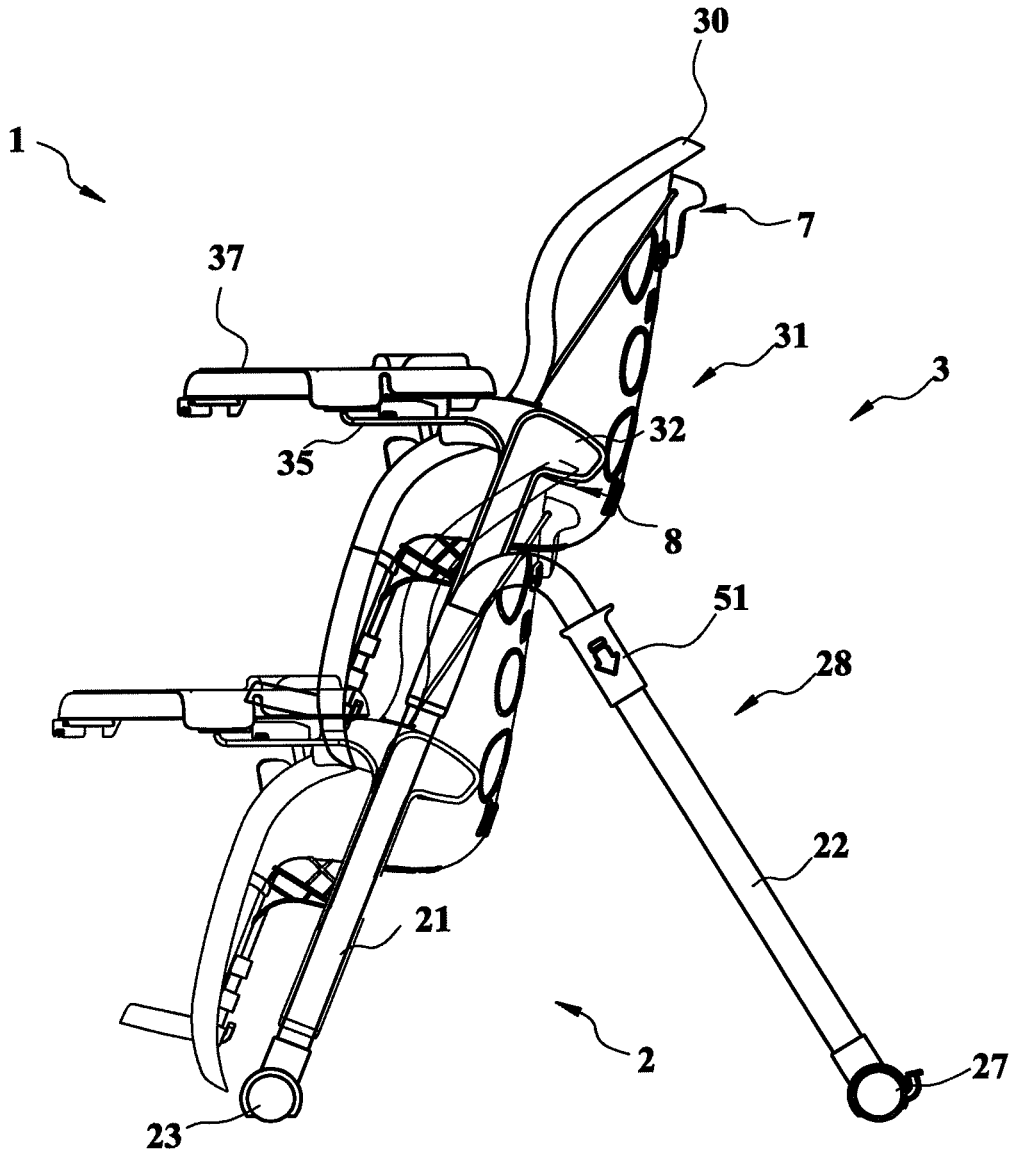
FIG. 12. is a side view showing the sliding sleeve is capable of carrying the seat body to a lowest position by traveling along the pair of rail struts.

Referring to FIGS. 10 to 12, the chair 3 includes a seat body 31 pivoted to the sliding sleeves 32 and can be rotated and locked in an ordinary use position 75 to accommodate an occupant and an inclined position 76 to lower the top portion 30 of the chair 3 to hide the high chair 1 under the dining table 10. The seat body 31 includes a butt support portion 33 for supporting an occupant and a backrest 34 connected with the driving handle 71.

In this embodiment, the sliding sleeves 32 may be formed with a plurality of positioning notches 36 for engaging with an inclination adjustment mechanism 7 so as to lock the seat body 31 in the ordinary use position 75 and the inclined position 76.

The inclination adjustment mechanism 7 may include a driving handle 71, a pair of positioning rods 72 and a resilient element 73.

The driving handle 71 may be operatively installed on the seat body 31. The pair of positioning rods 72 each may have an upper end connected with the driving handle 71, and a lower end engageable with one of the positioning notches 36. The resilient element 73 is used for biasing the positioning rods 72 to engage with one of the positioning notches 36 for releasably locking the seat body 31 in the ordinary use position 75 and the inclined position 76.

Accordingly, when the sliding sleeves 32 retained in the lowest position of its journey, the seat body 31 being adjusted and locked in the inclined position 76 shall lower the height of top portion 30 to less than twenty-eight (28) inches, this can facilitate the chair 3 to hide under a dining table 10 without the troublesome of folding and taking the foldable support frame 2 away from the dining table 10.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A high chair, including:

a foldable support frame, having a pair of rail struts and a pair of backup struts, the pair of backup struts being pivoted to the pair of rail struts and releasably locked in a use position by a spring-biased coupling sleeve; wherein the pair of rail struts are formed with a plurality of positioning holes for engaging with the locking elements, and each of the locking elements is biased by a spring to engage in one of the positioning holes for releasably locking the chair at a selected height;

a chair, having at least a top portion and a pair of sliding sleeves; the sliding sleeves being capable of sliding alone the pair of rail struts downward from a use position, until the top portion being lower than twenty-eight (28) inches above ground, so as to hide the chair under a dining table without folding and taking the foldable support frame away from the dining table; and a pair of positioning mechanism, mounted on the chair and associated with a pair of locking elements mounted in the sliding sleeves for releasably locking the sliding sleeves relative to the pair of rail struts, so as to adjust and fix the chair at a selected height; wherein the positioning mechanism includes a pair of driving triggers associated with the locking elements, for disengaging the locking elements from the positioning holes so as to adjust the chair to another selected position, and wherein the positioning mechanism farther includes a pair of linking element connected between the driving triggers and the locking elements.

2. The high chair of claim 1, further includes two front wheels connected to the pair of rail struts.

3. The high chair of claim 1, further includes two rear wheels connected to the pair of backup struts.

4. The high chair of claim 1, wherein the chair further includes a pair of armrests extended integrally from the sliding sleeves.

5. The high chair of claim 4, further includes a food tray engaged with the pair of armrests.

6. The high chair of claim 5, wherein the food tray is slidably engaged with the pair of armrests, and the armrests each being formed with a plurality of positioning indents for positioning the food tray in a selected position.

7. The high chair of claim 1, wherein the chair includes a seat body pivoted to the sliding sleeves and can be rotated and locked in an ordinary use position to accommodate an occupant and an inclined position to lower the top portion of the chair to hide the high chair under the dining table.

8. The high chair of claim 7, wherein the sliding sleeves are formed with a plurality of positioning notches for engaging with an inclination adjustment mechanism so as to lock the seat body in the ordinary use position and the inclined position.

9. A high chair including:

a foldable support frame, having a pair of rail struts and a pair of backup struts, the pair of backup struts being pivoted to the pair of rail struts and releasably locked in a use position by a spring-based coupling sleeve;

a chair, having at least a top portion and a pair of sliding sleeves the sliding sleeves being capable of sliding alone the pair of rail struts downward from a use position, until the top portion being lower than twenty eight (28) inches above ground, so as to hide the chair under a dining table without folding and taking the foldable support frame away from the dining table; wherein the chair includes a seat body pivoted to the sliding sleeves and can be rotated and locked in an ordinary use position to accommodate an occupant and an inclined position to lower the top portion of the chair to hide the high chair under the dining table; wherein the sliding sleeves are formed with a plurality of positioning notches for engaging with an inclination adjustment mechanism so as to lock the seat body in the ordinary use position and the inclined position:

a pair of positioning mechanism mounted on the chair and associated with a pair of locking elements mounted in the sliding sleeves for releasably locking the sliding sleeves relative to the pair of rail struts, so as to adjust and fix the chair at a selected height; and wherein the inclination adjustment mechanism includes:

a driving handle operatively installed on the seat body;

a pair of positioning rods, each having an upper end connected with the driving handle, and a lower end engageable with one of the positioning notches; and a resilient element for biasing the positioning rods to engage with one of the positioning notches for releasably locking the seat body in the ordinary use position and the inclined position.

10. The high chair of claim 9, wherein the seat body includes a butt support portion for supporting an occupant and a backrest connected with the driving handle.

11. The high chair of claim 9, wherein the pair of rail struts each has a bended section, and the backup struts is connected to lower end of the bended section by a pivot.

12. The high chair of claim 11, wherein the spring-biased coupling sleeve is slidably coupled to upper end of the backup struts, and biased by a resilient element to hold the bended section thereby locking the foldable support frame in the use position; and the spring-biased coupling sleeve can be withdrew from the bended section to permit the backup struts to rotate to a folded position.

* * * * *